United States Patent [19]

Takeuchi et al.

[11] Patent Number: 4,715,150

[45] Date of Patent: Dec. 29, 1987

[54] NONWOVEN FIBER ABRASIVE DISK

[75] Inventors: Masatoshi Takeuchi; Takayasu Hamagaki, both of Tokushima, Japan

[73] Assignee: Seiken Co., Ltd., Tokushima, Japan

[21] Appl. No.: 857,079

[22] Filed: Apr. 29, 1986

[51] Int. Cl.[4] ..... B24D 11/00

[52] U.S. Cl. ..... 51/395; 51/400; 51/402

[58] Field of Search ..... 15/230.16, 230.14, 230.12; 51/395, 396, 397, 400, 402

[56] References Cited

U.S. PATENT DOCUMENTS

| | | | |
|---|---|---|---|
| 1,988,874 | 1/1935 | Malcolm | 51/400 |
| 2,027,425 | 1/1936 | Hall | 15/230.16 |
| 2,121,496 | 6/1938 | Bowen | 51/402 |
| 2,770,928 | 11/1956 | Van Ormer | 51/397 |
| 2,958,593 | 11/1960 | Hoover | 51/400 |
| 3,377,151 | 4/1968 | Lanham | 51/400 |

FOREIGN PATENT DOCUMENTS

| | | | |
|---|---|---|---|
| 2421032 | 11/1979 | France | 51/400 |

*Primary Examiner*—Harold D. Whitehead

*Attorney, Agent, or Firm*—Wenderoth, Lind & Ponack

[57] ABSTRACT

A nonwoven fiber abrasive disk is formed with a hole in the center, from flexible fibers randomly oriented in all three dimensions. The abrasive disk has compressed regions that radiate out from the center to the perimeter, with uncompressed abrasive regions located between them. The fibers in the compressed regions are densely pressed together and hardened with bonding adhesive introduced into the gaps between those fibers, such that the disk thickness in those regions is less than that in the uncompressed abrasive regions. The abrasive regions of the disk, which are thicker than the compressed regions, protrude out to form the abrasive surface.

9 Claims, 7 Drawing Figures

NONWOVEN FIBER ABRASIVE DISK

BRIEF SUMMARY OF INVENTION

This invention relates to abrasive disks fabricated with nonwoven fibers, and in particular relates to motor driven abrasive disks that grind or polish by rotation.

Pressed fiber abrasive grinding wheel attachments formed in the shape of a disk with a hole in the center are currently in use. Such disks are attached to the axle of a grinding or polishing tool by sandwiching the disk center between washers. This arrangement has one disadvantage when compared to direct grinding or polishing with hand held abrasives. Namely, fibers are dislodged during application, causing the disk to wear down rapidly, resulting in an extremely short useful lifetime. This disadvantage can be minimized by compressing the fiber with large amounts of bonding adhesive to form a dense material. However, densely pressed compounds lose the advantageous cushioning property characteristic of nonwoven fibrous materials, thereby seriously limiting possible applications. A durable abrasive disk fully utilizing the inherent resilience of nonwoven fibrous material is in demand. Further, when disk R.P.M. is increased to improve the grinding performance of currently available disks, rapid (unsymmetrical) fiber separation causes an unbalanced centrifugal force which makes the tool vibrate. Consequently, existing disks cannot be used for high speed, high preformance grinding.

On object of the present invention is to provide a durable, long lasting, high efficiency (even at high R.P.M.) pressed fiber abrasive disk that can rotate in balance without vibration.

The above and further objects and novel features of the invention will more fully appear from the following detailed description when read in connection with the accompanying drawing. It is to be expressly understood, however, that the drawing is for purpose of illustration only and is not intended as a definition of the limits of the invention.

DETAILED DESCRIPTION

Figure 1:
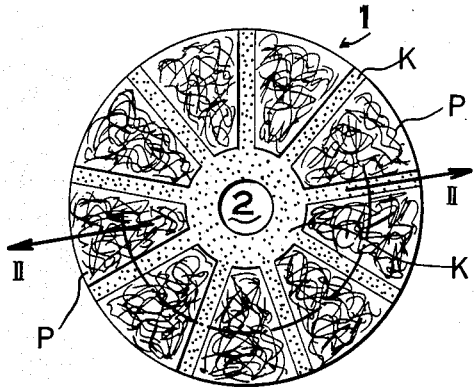
FIG. 1 is a face-on view of the prototype abrasive disk described in this invention.
Figure 2:
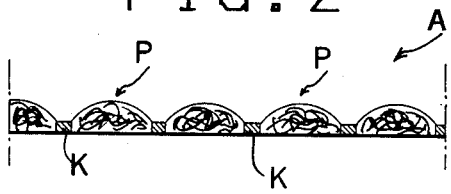
FIG. 2 is a cross-sectional view of the disk shown in FIG. 1 with the cross section taken along the arc II—II.

The nonwoven fiber abrasive disk shown in FIG. 1 and FIG. 2 is formed with a hole 2 in the center. The area around the center hole extending to the radial spoke-like regions K is compressed and bonded.

The abrasive disk 1 is shaped from fibers randomly oriented in all three dimensions to form a resilient solid which will flex somewhat during use.

Synthetic fibers such as nylon-6, nylon-66, tetylene, etc, as well as metal fibers can be used. Although the fiber size depends on the application, normally synthetic fiber thickness is set between 1 and 300 denier, and more desirably in the 10 to 200 denier range. Metal fiber diameters, calculated assuming a circular cross section, are set in the 0.1 to 1 mm range. Metal fibers can be wire made of iron, stainless steel, brass, copper, or aluminum, etc. with a circular cross section, or they can be fibers processed by cutting chunks of the above metals into fiber shaped pieces.

Figure 3:
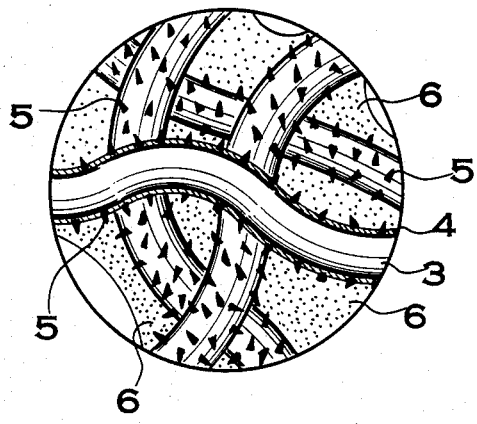
FIG. 3 is a magnified view of fibers of a section in a compressed region.

A magnified view of the compressed portion of the disk is shown in FIG. 3. An individual fiber 3 is covered, or mostly covered, with an abrasive coating 4. This coating is used to attach numerous particles 5 to the fiber 3, thus forming a rough surface.

Particles 5 can be attached to a fiber 3 by directly applying, or spraying a mixture of particles and coating adhesive on the fiber surface.

The abrasive disk 1 may be so thick that coating adhesive will not penetrate to the surface of inner fibers. In this event, adhesive can be thickly applied to the disk surface, or the disk 1 itself can be immersed in the coating adhesive. Before the coating adhesive hardens, the disk 1 can be pressed, allowing adhesive to penetrate to inner fibers. While this is done, excess adhesive can be removed, and the adhesive allowed to harden on the fiber surfaces.

The average size of particles 5 attached to a fiber 3 surface can be about the same size as the fiber diameter, smaller than the fiber diameter, or slightly larger than the fiber diameter. The particles may be any type of inorganic particulate such as calcium carbonate, silica (sand), etc., or any type of crushed organic compound such as pulverized coconut shell, etc.

In the uncompressed sectors P of the disk, the fiber surfaces can be coated with a mixture of adhesive and grinding powder (abrasive particles made for grinding) in place of the above mentioned particles.

As shown in FIG. 2, individual fibers 3 with surfaces roughened by particles 5 are compressed and hardened in regions K. In a compressed region, such as that shown magnified in FIG. 3, the gaps 6 between fibers 3 are filled with bonding adhesive to form a solid body.

In compressed regions K, adhesives like urethane based glues, which will expand into the gaps 6 and solidify adjacent fibers 3 are most suitable. Such adhesives will permeate between fibers 3 by means of a self-generated pressure of expansion, resulting in good solidification of the compressed regions K.

To densely compress fibers 3 in forming solid regions K, these areas are pressed to a thickness of one-half to one-twentieth the uncompressed thickness of the disk.

Therefore, bonding adhesive that solidifies the compressed regions K is compacted with fibers and set in the same manner as that near the perimeter of the center hole 2.

The coating adhesive which attaches particles 5 to individual fibers 3 can serve the dual purpose of also bonding fibers solidly together in the compressed regions K. This can be accomplished in practice by applying coating adhesive mixed with coating particles to all fiber 3 surfaces. Near the end of the coating adhesive's solidification process, the fibers of radial segments K can be tightly compressed and held in that state until solid.

In the case where a separate bonding adhesive (in addition to the coating adhesive used to hold particles 5 to fibers 3) is used to bond fibers together in the compressed regions K, the adhesive is applied to the disk 1 in the spoke-like pattern, then the entire disk, or only the areas with adhesive applied are tightly compressed and solidified.

It is best to have most of the fibers solidly connected to a compressed region of the disk 1. This construction prevents fibers from easily falling out during use, and thus improves the disk's endurance and lifetime. Therefore, the overall length of the unwoven fibers comprising the abrasive disk should be longer than the most separated parts of adjacent compressed areas. For long fibers there is a high probability that an end will be anchored at a compressed region.

It is also desirable, considering the disk's outside diameter and other factors, to space the compressed areas at 20 to 90 degree intervals. Further, it is not always necessary for the compressed regions to extend exactly to the outer perimeter of the disk. For example, a 20 mm separation between the outer perimeter of the disk and the compressed spoke-like regions is possible.

Incidentally, the abrasive disk can be given excellent cushioning properties by increasing the disk's bulk. This can be accomplished by bending thick fibers to the necessary radius of curvature, and forming the disk from a surplus of these fibers.

The overall disk thickness is typically 10 mm to 50 mm. The width of the compressed region K is typically set from 1 mm to 20 mm. However, compressed region K width in the 5 mm to 10 mm range is desirable.

The compressed regions K of the disk are hardened such that they will deform very little or not at all when squeezed with the fingers.

As shown in FIG. 2, the abrasive surface A (located in the upper portion of FIG. 2) is made up of convex uncompressed regions P and concave compressed regions K. Therefore, during actual application, the uncompressed regions P exert a cushioned pressure on surfaces to be ground or polished.

As indicated in FIG. 2, a cross section taken along a 180 degree arc of the disk displays a wave-like corrugated pattern with uncompressed areas bulging outward.

Figure 4:
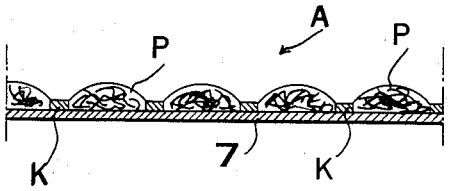
FIG. 4 is a cross-sectional view along an arc of a prototype variation.

Furthermore, as shown in FIG. 4, it is possible to reinforce the abrasive disk by attaching a flexible sheet 7 to the backside of the disk. The compressed region near the center hole and the compressed spoke-like regions K can serve as attachment points for this purpose. This reinforcing sheet can be cloth, densely compressed nonwoven fiber, or synthetic resin, etc.

Figure 5:
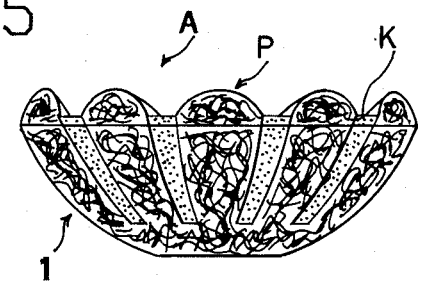
FIG. 5 is a side view of another prototype abrasive disk.
Figure 6:
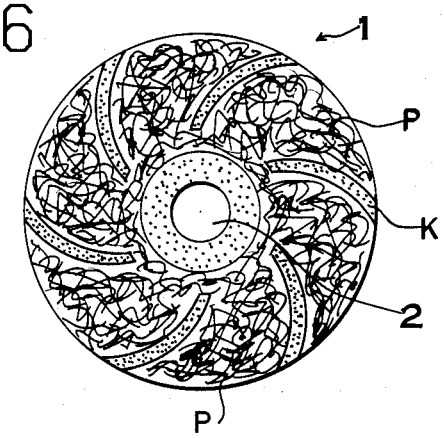
FIGS. 6 and 7 are face-on views of different prototype abrasive disks.

The abrasive disk 1 shown in FIG. 5 is formed into an overall conical shape. In the figure, the upper suface of the abrasive disk 1 is the abrasive surface A which has thinly compressed regions K giving it an alternating concave and convex or corrugated pattern. The compressed regions of the abrasive disk are formed either, as shown in FIG. 1, as outward radiating straight lines, or, as shown in FIG. 6, as curved radial lines that describe a vortex pattern. The abrasive disk has uncompressed abrasive regions P which protrude out between the radial compressed regions K.

During application, when the conical abrasive disk 1 is pushed against the surface of an object to be ground or polished, the outer perimeter portion of the abrasive surface A contacts the surface of the object describing a circular shaped contact region with the required width, and the central portion of the abrasive surface A does not touch the object. The abrasive disk 1 very effectively grinds or polishes the surface of an object by contacting that object with its outer edge. The reason for this is that the nonwoven fibers are more abrasive at the outer edge where the fibers are sliced (and the cut ends are exposed) than at the disk surface. In other words, particularly at the beginning of a job, the conical abrasive disk 1, which contacts objects with its truncated outer edge, has more abrasive ability than a disk which contacts objects with both its central and outer edge portion.

Figure 7:
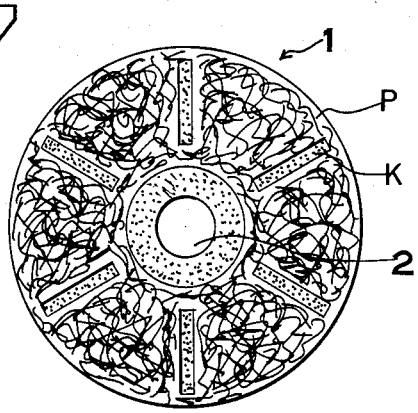

Further, as shown in FIG. 7, it is not always necessary for the radial compressed regions K to extend to and connect with the compressed region surrounding the center hole.

The compressed areas of an abrasive disk formed by the following process are bonded extremely solidly. Compressed region fibers are not directly compressed and solidified with bonding adhesive, but rather fibers are first totally (or mostly) covered with coating adhesive to hold small particles which roughen the fiber surfaces. The easily connected roughened fibers are then squeezed together under pressure, and solidified in this state with bonding adhesive. The compressed fibers do not necessarily have to be completely embedded in bonding adhesive. Even with gaps between fibers, or even when the surface area common to adjacent fibers that are pressed together is somewhat small, a strong compressed region can be formed by this simple process.

Although not diagrammatically shown, compressed regions can also be formed without first attaching particles to fibers in those regions, but rather by directly compressing and bonding the fibers in those regions.

The disk's flexible fibers are compressed together at equal intervals to form a spoke-like pattern. Fibers in the compressed regions are recessed from the active abrasive surface while fibers in the uncompressed regions bulge out from the face of the disk. Because of the exceptional resilience of the flexible fibers in the uncompressed areas, a cushioned pressure is exerted on surfaces during grinding or polishing. After a certain amount of use, the fibers comprising an abrasive surface will wear and become severed from the disk. Because fibers in the uncompressed regions are solidly anchored to the spoke-like regions on the prototype disk, partially worn fibers will remain attached. Thus partially worn fibers will continue to provide abrasive action until the entire disk (including the compressed and bonded regions) is worn.

Further, partially worn fibers in the uncompressed regions maintain sufficient abrasive properties until they are completely worn and severed from the disk. The ability to maintain exceptional abrasiveness with wear occurs for the following reason. Uncompressed regions with partially worn fibers resemble a cross-sectional slice or disk edge more than a flat surface or disk face. The outer edge of any nonwoven fiber disk has a much greater grinding ability than the face of that disk. The face of the prototype disk with partially worn fibers has a grinding ability analogous to this outer edge.

Moreover, even after partial fiber loss, the disk will maintain ample stiffness, and not weaken or lose shape. Consequently, excellent abrasive properties can be maintained over extremely long periods. Furthermore, operation at high R.P.M. for long periods is possible, providing for highly efficient grinding.

Since the disk does not lose shape during high R.P.M. operation, it will remain balanced, and can operate at high speeds for long periods without vibration.

In addition, even though long endurance is achieved, the inherent resilience and cushioning properties of the nonwoven fibers are not lost. This is because abrasion is produced by the uncompressed regions of the disk.

Incidentally, experiments were performed with a prototype abrasive disk having an outside diameter of 15 cm, compressed and bonded areas 40 degrees apart with a width of 8 mm and a thickness of 1.5 mm, and having a thickness of 13 mm in the uncompressed regions. Results of a comparison with a similar disk made of the same materials but without compressed radial areas, show that the grinding ability of the prototype was several orders of magnitude better, and that the endurance of the prototype was at least three times better than the conventional disk.

What is claimed is:

1. A nonwoven fiber abrasive disk comprising flexible fibers randomly oriented in all three dimensions and formed into a disk shape with a center hole, said disk having radial compressed regions and respective uncompressed regions between said compressed regions, said fibers being densely pressed in said compressed regions to a thickness less than in said uncompressed regions such that said compressed regions are recessed with respect to said uncompressed regions which thereby protrude out from the surface of said disk to form an abrasive surface, and wherein said compressed regions are solidified with bonding adhesive in gaps among said fibers in said compressed region.

2. A nonwoven fiber abrasive disk as claimed in claim 1 wherein a compressed region is formed around the center hole and is connected with the above said radial compressed regions.

3. A nonwoven fiber abrasive disk as claimed in claim 1 wherein a cross section along an arc through the compressed and uncompressed regions is a wave-like corrugated pattern.

4. A nonwoven fiber abrasive disk as claimed in claim 1 wherein the thickness of said compressed regions is from one-half to one-twentieth the thickness of said uncompressed regions.

5. A nonwoven fiber abrasive disk as claimed in claim 4 wherein the abrasive particles are attached to the fiber surfaces with a coating adhesive, and that adhesive serves the dual purpose of bonding fibers densely together in the said compressed regions.

6. A nonwoven fiber abrasive disk as claimed in claim 1 wherein said compressed regions are solidified with bonding adhesive that expands and permeates into the gaps between the fibers.

7. A nonwoven fiber abrasive disk as claimed in claim 1 wherein said radial compressed areas are formed at 20 to 90 degree intervals.

8. A nonwoven fiber abrasive disk as claimed in claim 1 wherein said radial compressed regions which are separated from the outer perimeter by 0 to 20 mm.

9. A nonwoven fiber abrasive disk comprising flexible fibers randomly oriented in all three dimensions and formed into a disk shape with a center hole, said disk having radial compressed regions and respecting uncompressed regions between said compressed regions, said fibers being densely pressed in said compressed regions to a thickness less than in said uncompressed regions such that said compressed regions are recessed with respect to said uncompressed regions which thereby protrude out from the surface of said disk to form an abrasive surface, and wherein abrasive particles are bonded to said fibers throughout substantially the entire thicknesses of said compressed and uncompressed regions and wherein said compressed regions are solidified with bonding adhesive in gaps among said fibers in said compressed regions.

* * * * *